United States Patent [19]

Mueller

[11] 4,309,893

[45] Jan. 12, 1982

[54] PLUG-SHAPED PRESS CROWN FOR A PRESS ASSEMBLY

[75] Inventor: Erwin R. Mueller, Milwaukee, Wis.

[73] Assignee: Rexnord Inc., Milwaukee, Wis.

[21] Appl. No.: 70,381

[22] Filed: Aug. 27, 1979

[51] Int. Cl.[3] ..... B21J 13/04

[52] U.S. Cl. ..... 72/455; 72/453.01; 100/214

[58] Field of Search ..... 72/455, 453.01, 453.18; 100/214, 269

[56] References Cited

U.S. PATENT DOCUMENTS

| | | | |
|---|---|---|---|
| 2,331,126 | 10/1943 | Loomis | 100/214 |
| 2,482,346 | 9/1949 | Kinker | 100/214 |
| 2,574,892 | 11/1951 | Schmidt | 100/214 |
| 2,680,881 | 6/1954 | Mock | 100/214 |
| 3,717,024 | 2/1973 | Davison | 100/214 |
| 3,841,143 | 10/1974 | Harada | 72/453.01 |

FOREIGN PATENT DOCUMENTS

| | | | |
|---|---|---|---|
| 2818511 | 10/1978 | Fed. Rep. of Germany | 100/214 |
| 305083 | 7/1971 | U.S.S.R. | 100/214 |

*Primary Examiner*—Gene P. Crosby

*Attorney, Agent, or Firm*—Vance A. Smith; Aaron L. Hardt

[57] ABSTRACT

A press crown having a central plug characterized by having a greater stiffness than the surrounding transitional region connecting the plug to a plurality of lugs. The shape of the press crown transfers a significant portion of the deflection to occur in the transitional region. This substantially reduces the possibility of the deflection causing undesirable lateral forces to act upon the tooling apparatus.

4 Claims, 7 Drawing Figures

PLUG-SHAPED PRESS CROWN FOR A PRESS ASSEMBLY

BACKGROUND OF THE INVENTION

1. Field of the Invention

This invention pertains to hydraulic presses in the medium to high tonnage range, and particularly to those presses employed to exert very high forces over a small area as required, for example, in the processing of industrial diamonds.

2. Discussion of the Prior Art and Problems

Generally, the function of a hydraulic press is to provide a structure within which high forces are exerted upon a tooling or die assembly containing parts or materials to be processed, produced, or changed in size or shape. Such presses ordinarily include a force member, e.g., hydraulic ram or piston with an attached platen opposed by a resisting member known as a press crown or top head. Both the force and resisting member are retained in their relationship to each other by a number of columns, or by a housing frame of tie rod combinations.

The columns or tie rods normally extend through bores in the cylinder and press crown and are tightened by a nut at each end to a level which equals or exceeds the full tonnage of the press. This is called preloading and, while minimizing stress fluctuations, provides rigidity in this condition to prevent the separation of "parts" during the pressing cycle. The reduction of movement under load generally increases the life of "parts". The "parts" referred to above are within a tooling apparatus, i.e. die assembly or the like, and consist of several mating elements which are tailored for a specific application. The elements of the tooling apparatus are normally attached to both the press crown and platen through which the cylinder will exert its force, close the elements about a material, and produce a useful item.

The press crown can be considered a beam fixed between two or more points, i.e., the columns or tie rods. The distance between the points is called the span. The amount of deflection induced into the press crown is a function of its span, the force imparted by the force member, and the depth of the press crown. For a given span and force, i.e. load, the deflection can be varied only by a significant change in the depth of the press crown. Thus, if it were desired to decrease the deflection induced by a specific load, the depth or vertical section of the press crown between the fixed points would have to be increased by a considerable amount. A practical problem then results, since the increased depth of the press crown adds considerable weight and, therefore, cost to the entire press assembly.

When employing presses in applications requiring close tolerances, it is absolutely imperative that the deflection in the press crown, which adversely affects the adjoining tool package by imposing additional lateral forces, be minimized. For example, in ultra high load applications, it is necessary to use tungsten or similar materials as the tooling composition to resist the pressures and temperatures. Tungsten, however, like many materials with a high Young's Modulus has poor bending ability. Where precise mating of die assemblies in the tooling apparatus is a requirement, relative lateral movement of one die to the other could add additional stresses and result in premature failure.

It is therefore one object of the present invention to provide for a press assembly with a press crown which will resist and complement the hydraulic forces transferred through the tooling apparatus. Another object of this invention is to provide a press crown with a shape which transfers a significant amount of deflection to a portion of the press crown outside of the region above the tooling apparatus. Still another object is to provide a press crown with a transitional region connecting its center to the portions receiving the columns or tie rods, which regions will minimize bending of the columns or tie rods in the preload condition.

SUMMARY OF THE INVENTION

An improved press crown, for use with a press in applications employing ultra high pressures, in which the crown is comprised of three regions: a central plug of a predetermined depth or vertical section; a plurality of lug portions, each of which is adapted to receive and be secured to a press tying member; and a transitional region extending from the central plug to the lug portions. The transitional region has a vertical section or depth which has less strength than that of the central plug. Under loaded conditions, the greater stiffness of the central plug resists deflection which is transferred to the weaker region. In other words, the natural deflection under load occurs outside of the plug section in the surrounding transitional region, thus lessening the transverse forces which otherwise operate on the tooling apparatus.

These and other useful advantages will become clear upon a reading of the following detailed description and appended drawings.

DETAILED DESCRIPTION OF THE PREFERRED EMBODIMENT

Figure 2:
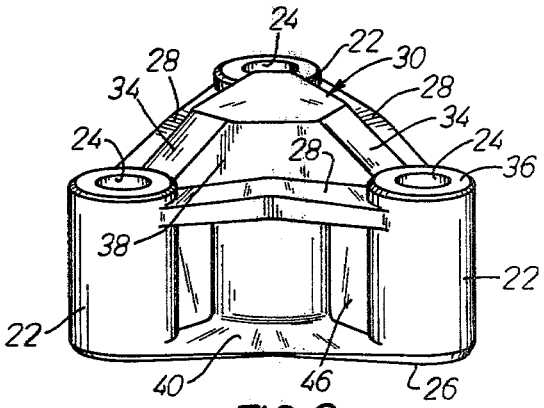
FIG. 2 is a perspective view of the press crown shown in FIG. 1.
Figure 1:
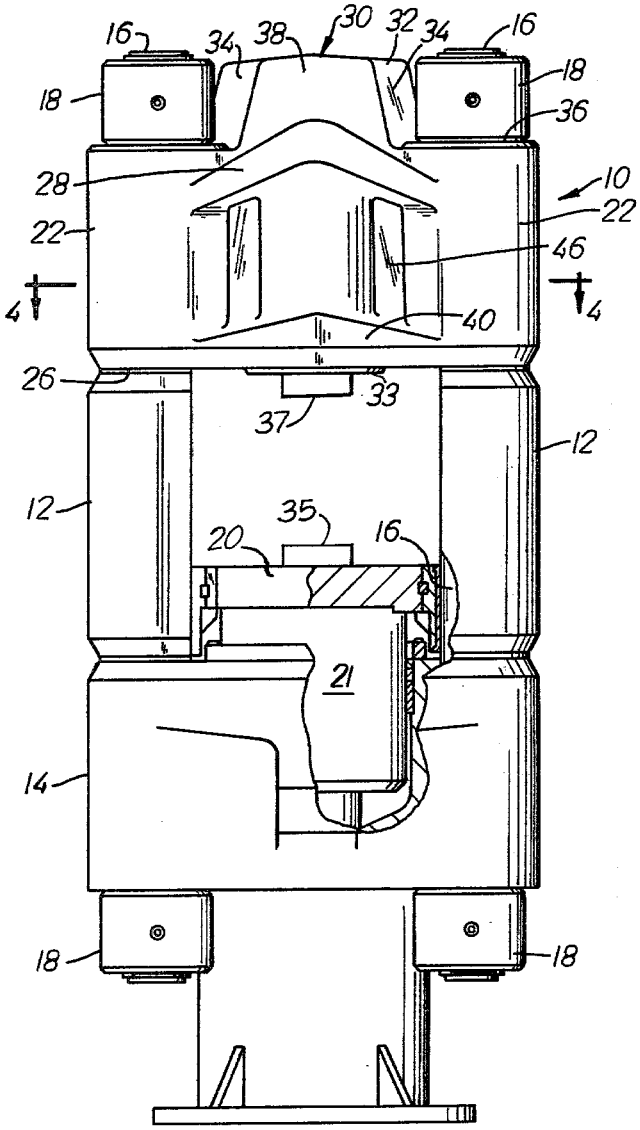
FIG. 1 is a front view of a press assembly employing a press crown in accordance with the present invention.

FIG. 1 provides a front view of a press assembly with an improved press crown in accordance with the present invention. As perhaps best seen in the perspective of FIG. 2, the press assembly described herein has three tie rods. It is understood, however, that the number of tie rods employed is not important for purposes of the invention. The assembly itself comprises a press crown 10, a plurality of compression members 12, a cylinder 14, and a plurality of tie rods 16.

Tie rods 16 function, as the name implies, to tie the entire assembly together into a stable structure. Together with compression members 12, tie rods 16 are usually preloaded to provide a clamping effect for greater stability to the press assembly, so that when the assembly is under a working load, the stretch of tie rods 16 is reduced, and additional stresses are minimized. Preloading prevents what is known in trade as "lift off" which results in the separation of parts during a pressing cycle, a particularly disastrous occurrence when carefully mated die assemblies are employed.

Securing tie rods 16 to press crown 10 and cylinder 14 are nuts 18 threaded onto to both ends of rods 16. Preloading as discussed above is often accomplished by heating, thus elongating, the tie rods in position in the press assembly and tightening the nuts. Compression members 12, cylinder 14 and crown 10 are then preloaded in compression while tie rods 16, as they cool, become preloaded in tension.

Compression members 12 as depicted are half-sleeves and juxtaposed about the outer surface of tie rods 16. This feature is discussed in co-pending application Ser. No. 049,030 assigned to the same assignee as the present invention, now U.S. Pat. No. 4,240,342. Moveable platen 20 secured to the hydraulic ram 21 is caused to guide on the inner surface of rods 16, providing a reduced span for both the crown and the platen without affecting the size of the working area between tie rods 16. None of the features are, however, germane to the present invention. Reference may be made to the aforementioned copending application for details of the features.

Press crown 10 is generally discernible as having three distinct but integral regions. As illustrated, one region comprises three cylindrically shaped lug portions 22, each of which has a bore 24 for receiving a tie rod 16. The bottom surface 26 abuts a compressive member 12.

The portion of crown 10 centrally positioned intermediate lug portions 22 is plug region 30. The distinguishing characteristic of plug region 30 is its greater vertical section compared, for example, to lug portions 22. The top region of plug 30 has a horizontal portion 32 which extends with its surface into a sharp downward slope 34 which leads into the horizontal mounting face 36 of lug 22. Wear plate 33 is mounted on plug section 30. A die 35 mounted on platen 20 and a die 37 mounted on wear plate 33 comprise the tooling apparatus for the press assembly.

Extending from one adjacent lug portion 22 to another is a flange 28 having an inverted V-shape. As shown, flanges 28 extend across vertical side surfaces 38 of plug region 30. Flange 28 becomes increasingly larger in vertical section toward its apex. Spaced beneath flange 28 is a similarly shaped flange 40 which also extends from one adjacent lug portion 22 to another.

Flanges 28, 40 provide vertical stability to plug section 30 and offer rigidity against the lateral reaction forces created at the point where the tie rods are secured to the press crown. The size and slant of the flanges are largely dependent on the tonnage of the press and the span between tie rod center lines.

Figure 3:
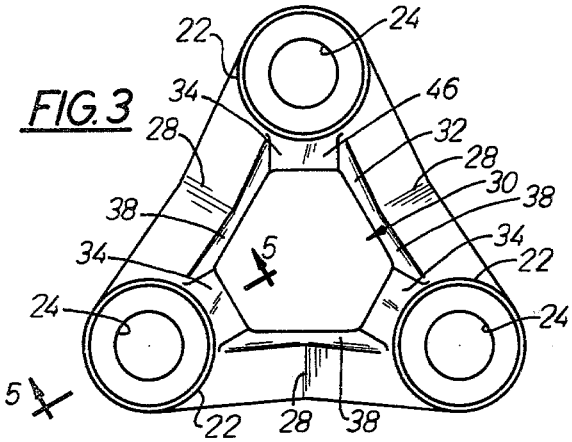
FIG. 3 is a top view of FIG. 1.
Figure 4:
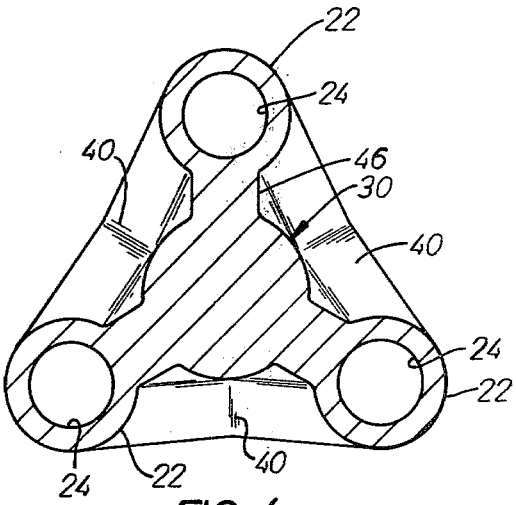
FIG. 4 is a sectional view taken along lines 4—4 of FIG. 1.
Figure 5:
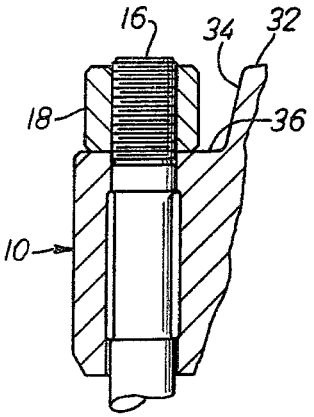
FIG. 5 is a sectional view taken along lines 5—5 of FIG. 3.

Lying generally between bores 24 and the lower periphery of plug section 30 is the third region, a transitional region in which an arm 46, shown in FIGS. 3 and 4, extends from each lug 22 to the plug 30. Each arm 46 is distinct from each other arm 46. This region is characterized by a significantly shorter vertical section and is weaker in comparison to the plug section 30. The transitional region thus has considerably less resistance to the deflection induced into press crown 10 when a load is imposed. Additionally, both flanges 28 and 40 are less in section in this region.

Figure 6:
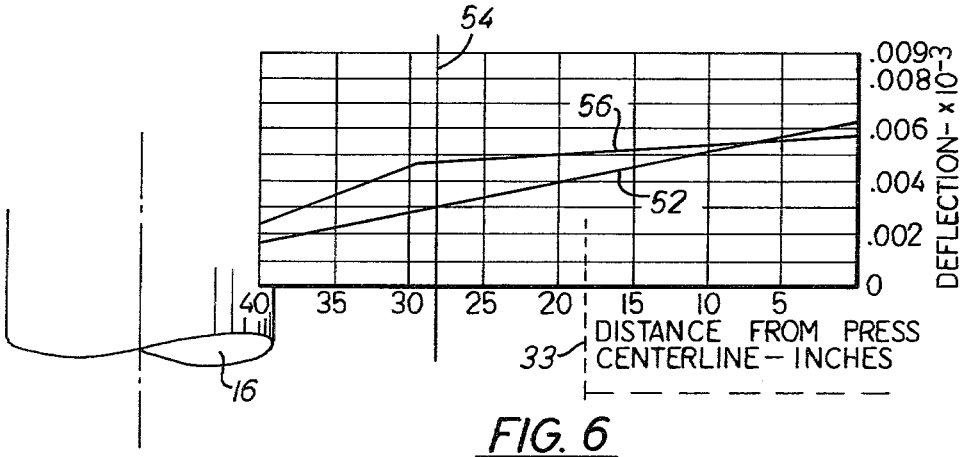
FIG. 6 is a graphical representation comparing deflection occurring in a solid press crown of a prior art press with deflection occurring in a press employing the shaped press crown of the present invention.

Reference is now made to FIG. 6, which shall serve as an example showing in graphical representation the deflection that occurs in the press crown of a three column press under a load of 5000 tons. The abscissa axis reads from right to left in inches measured from the center of the press assembly to the center line of the tie rod. A 36 inch diameter wear plate 33 is centered on the vertical axis beneath the horizontal axis for reference purposes. On the extreme left side of the graph is a pictorial representation of a column with its center line approximately 48 inches from the press center line. The ordinate axis reads in thousandths of inches and is a measure of deflection for the press crown subjected to full tonnage.

The curve 52 represents values of deflection occurring in a "solid" steel press crown 64 inches in depth, a crown typical for those found in the prior art, particularly in 5,000 ton, 3 column presses. Curve 52 has an essentially steady slope from a vertical reference line 54 intersecting the abscissa or horizontal axis at the 28 inch reference mark to the press center line. Line 54 lies outside of an imaginary cylinder of which the wear plate 33 is a section. The differential deflection measured along the horizontal axis between line 54 and the ordinate axis, i.e. a 28 inch radius from the press center line, is about $39\times10^{-3}$ inches.

Curve 56 represents the deflection occurring in a 5000 ton, 3 column press employing a press crown in accordance with the present invention. From line 54 to the press center line, curve 56 rises only slightly. The deflection in this interval is about $1.8\times10^{-3}$ inches or less than half the deflection measured along curve 52 in the identical interval. The total deflection measured from the center line to the 40 inch is approximately the same for both curves 52 and 56.

A dramatic difference is noted in the horizontal interval lying between 28 and 40 inches from the center line. The total deflection occurring in this interval is much smaller for curve 52 than for curve 56. As evident, the slope of curve 56 is much greater in this region. From the graph, it is evident that a much larger percentage of deflection occurs outside of line 54 toward tie rods 16 when employing a press crown of the present invention than when using a solid press crown of the prior art. Thus, from the above it can be seen that transitional regions 46 lie outside of the aforesaid imaginary cylinder or, stated differently, lie a greater horizontal distance from the central longitudinal axis 48 of the press assembly than tooling apparatus.

Figure 7:
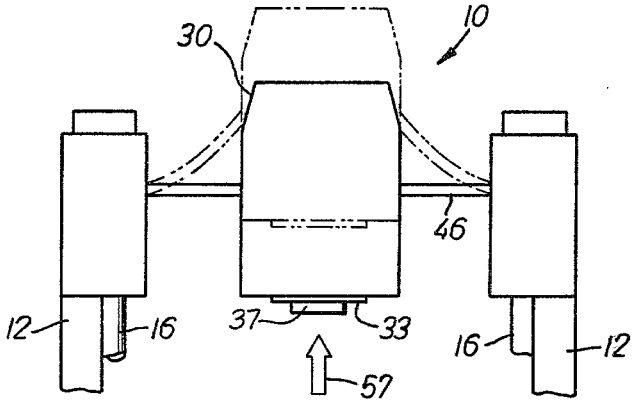
FIG. 7 is an illustration (not to scale) depicting the transfer of deflection to occur mainly in the transition region.

To more clearly portray the transfer of deflection provided by the shaped press crown of the present invention, reference is made to FIG. 7. Press crown 10 is shown fixed between tie rods 16. A force depicted as arrow 57 is directed toward wear plate 33. Press crown 10 is deflected with a major portion of the deflection occurring outside of the region directly above the wear plate 33, i.e. the transition region comprising arms 46. Of course, the dimensions of the transition region are exaggerated for purposes of illustration. In effect, the arms 46 are acting as springs and are more readily deflected than the plug region. The dashed lines indicate that the entire wear plate moves as a unit upward and experiences little bending or lateral deflection.

It is thus the shape of the improved press crown which alters the normal constant slope of the deflection, transferring deflection to the transitional region which in prior art presses would occur above the wear plate. When subjected to a load applied to the center of the bottom face along the wear plate 33, the heavy central plug region 30, having a much greater stiffness, shifts the major portion of the bending deflection to the weakest section of the press crown, i.e. the transitional region. The meaningful aspect of this transfer is that the region above the wear plate, and therefore above the tooling assembly, experiences not only less deflection, but a smaller increase of deflection in a direction toward the press assembly center line. The tooling apparatus itself, in comparison to a press assembly employing a solid press crown, will experience much reduced lateral movement. This, of course, is a significant benefit where ultra high pressure applications are required or where close tolerances are necessary in the mating of the dies parts.

To provide a solid press crown, resulting in a similar reduction of deflection in the vertical tooling apparatus region, would require a significant increase in the press crown depth along its entire span, adding considerably to the weight and cost of the assembly, or, alternatively, a reduction in the span between columns or tie rods. The latter would reduce the useful working area within the press assembly.

Other modifications and variations will be obvious to those skilled in the art having read the material disclosed in this specification. It is the intention that such modifications and variations be within the spirit of the scope of appended claims.

I claim:

1. A press assembly for reducing the transverse forces acting upon the tooling apparatus thereof due to deflection induced in the press crown thereof when said assembly is under load, said assembly comprising:

a. said press crown, b. a force member including a movable platen, c. said tooling apparatus including paired die members, one die member secured to said platen and the other to the surface of said press crown facing said platen, and d. a plurality of tying members tying said assembly together;

said press crown further comprising a central portion of a predetermined vertical section, a plurality of lug portions adapted to be secured to said tying members, and a transitional portion of a vertical section less than that of said central portion, said transitional portion comprising a plurality of arms each extending from a respective lug portion to said central portion and integral with said central and lug portions, said arms lying a greater horizontal distance from the central longitudinal axis of the press assembly than said tooling apparatus.

2. A press assembly having an improved press crown, said assembly including a plurality of tying members tying together said press crown, a force member including a movable platen mounted for longitudinal movement between said tying members, and tooling apparatus consisting of a die mounted on said platen and a second die mounted on the platen-facing surface of said press crown, said improved press crown comprising:

a. a central plug having a predetermined stiffness, b. a plurality of lug portions each having a bore for receiving one said tying member, c. a plurality of transitional means spaced from one another and connecting a respective lug portion to said central plug, said plurality of transitional means each being an integral extension of said central plug and having less thickness and height than said central plug for deflecting to a greater extent than said central plug when said press assembly is in operation; and d. a pair of vertically spaced flanges oriented substantially horizontally and extending between adjacent lug portions across and integral to vertical surfaces of said central plug and transition means therebetween.

3. In the press assembly of claim 2, the upper flange of each pair of flanges having the shape of an inverted V and being of heavier section toward the center of said central plug.

4. In the press assembly of claim 2, the upper flange of each pair of flanges having the shape of an inverted V and being of heavier section toward the center of said central plug and the lower flange of each pair of flanges also being heavier in section toward the center of said plug.

* * * * *